US006868975B2

(12) United States Patent
Sells et al.

(10) Patent No.: US 6,868,975 B2
(45) Date of Patent: Mar. 22, 2005

(54) REVOLVING GUN SAFETY CABINET

(76) Inventors: Rex R. Sells, 386 Harley La., Bedford, KY (US) 40006; Todd Webster, 386 Harley La., Bedford, KY (US) 40006

( * ) Notice: Subject to any disclaimer, the term of this patent is extended or adjusted under 35 U.S.C. 154(b) by 0 days.

(21) Appl. No.: 10/417,075

(22) Filed: Apr. 17, 2003

(65) Prior Publication Data

US 2004/0045914 A1 Mar. 11, 2004

Related U.S. Application Data

(60) Provisional application No. 60/372,793, filed on Apr. 17, 2002.

(51) Int. Cl.[7] ..... E05B 73/00; A47F 7/00

(52) U.S. Cl. ..... 211/4; 211/64; 211/163

(58) Field of Search ..... 211/4, 64, 163, 211/70, 78, 70.8, 60.1, 70.5, 205; 206/317; 42/106; 312/128, 138.1, 114, 249.2, 125, 135; 70/36, 37, 58, 61, 62, 77, 57.1

(56) References Cited

U.S. PATENT DOCUMENTS

| | | | | | |
|---|---|---|---|---|---|
| 492,304 | A | * | 2/1893 | Markle | 312/135 |
| 2,158,623 | A | * | 5/1939 | Fischbacher | 312/6 |
| 2,512,622 | A | * | 6/1950 | Fish | 206/317 |
| 3,685,661 | A | | 8/1972 | Kimmel | 211/64 |
| 3,826,378 | A | * | 7/1974 | Novak | 211/70.5 |
| 3,927,923 | A | * | 12/1975 | Kimmel | 312/125 |
| 4,099,808 | A | * | 7/1978 | Oakley et al. | 312/297 |
| 4,688,685 | A | * | 8/1987 | Brace | 211/70.5 |
| 5,180,222 | A | * | 1/1993 | Robinson | 362/125 |
| 5,265,950 | A | * | 11/1993 | Atkinson | 312/216 |
| 5,454,931 | A | * | 10/1995 | Lauve, Jr. | 206/317 |
| 5,772,295 | A | * | 6/1998 | Sundmark | 312/246 |
| 6,042,207 | A | * | 3/2000 | Crosby et al. | 312/351 |
| 6,142,319 | A | * | 11/2000 | Kim | 211/70.2 |
| D435,182 | S | | 12/2000 | Mason | D6/457 |
| 6,241,105 | B1 | | 6/2001 | Pomper | 211/85.2 |
| 6,302,052 | B1 | | 10/2001 | Sauerwein | 114/351 |
| 6,305,534 | B1 | * | 10/2001 | Neal | 206/315.11 |
| 6,308,838 | B1 | | 10/2001 | Endean | 211/37 |
| 6,330,815 | B1 | | 12/2001 | Duncan | 70/58 |
| 6,364,124 | B1 | * | 4/2002 | Chen | 211/4 |
| 6,619,082 | B1 | * | 9/2003 | Bentley | 70/58 |
| 2003/0015486 | A1 | * | 1/2003 | Chen | 211/70 |
| 2004/0061419 | A1 | * | 4/2004 | Gallea | 312/238 |

* cited by examiner

*Primary Examiner*—Jennifer E. Novosad
(74) *Attorney, Agent, or Firm*—Richard C. Litman

(57) ABSTRACT

A revolving gun safety cabinet for holding and securing a plurality of rifles, shotguns and pistols. The revolving gun safety cabinet is made up of a multisided cabinet shell, a multisided storage compartment base used to support the multisided cabinet shell and to store gun accessories and supplies, a vertical post set within the center of the multisided exterior cabinet shell and a relatively large lower horizontal disk adapted to receive the butts of the rifles and shotguns held vertically upright within the revolving gun safety cabinet. There is also a relatively small upper horizontal disk adapted to receive the barrels of rifles and shotguns held vertically upright within the revolving gun safety cabinet and a locking mechanism to secure the rifles and shotguns to the vertical post.

16 Claims, 5 Drawing Sheets

REVOLVING GUN SAFETY CABINET

CROSS-REFERENCE TO RELATED APPLICATION

This application claims the benefit of U.S. Provisional Patent Application Ser. No. 60/372,793, filed Apr. 17, 2002.

1. Field of the Invention

The present invention relates to a revolving gun safety cabinet. More specifically, the invention relates to a safe storage cabinet for rifles, shotguns and pistols.

2. Description of the Art

Firearms have always been an important part of American tradition. Their availability is guaranteed in our Constitution and their usage is prevalent throughout all socioeconomic levels. Firearms are used extensively by hunters, policemen and soldiers and their safe usage and storage are paramount to us all. Firearm safety and storage devices for shotguns, rifles and handguns have been extensively developed since their initial usage and are well represented in the related art.

U.S. Pat. No. Des. 435,182 issued to Mason, outlines an ornamental design for a merchandise display stand.

U.S. Pat. No. 492,304 issued to Markle, outlines a gun case for retailers' use in holding guns and exhibiting them. The gun case includes a casing with a vertical shaft and a top holding disk, an intermediate holding disk and a bottom holding disk. The three holding disks are attached to the vertical shaft by set screws, with the disks being capable of holding long guns, average sized guns and short guns.

U.S. Pat. No. 3,685,661 issued to Kimmel, outlines a revolving gun cabinet with a vertical post provided with a relatively large lower disc and a relatively small upper disc, able to support the stocks of a plurality of guns of various sizes and shapes. The post and discs are rotatable manually about the post axis where a user can rotate to gain access to any gun desired.

U.S. Pat. No. 6,241,105 issued to Pomper, outlines a display stand with a vertical post assembly mounted on a base. A plurality of spokes and a retaining ring are mounted at the upper end of the post. The spokes are movably mounted to be biased in an upward direction. Rotatably attached to the upper end of the post is a center cap adapted to retain the spokes depressed with the post. The cap has an axial slot permitting a selected spoke to automatically rise, when properly rotated.

U.S. Pat. No. 6,302,052 issued to Sauerwein, outlines a horizontal shotgun and rifle rack assembly for hunting boats and includes first and second racks to be mounted forward and aft of each other on a side of a boat. The first and second racks each have upper and lower, upwardly opening, U-shaped gun cradles for receiving, supporting and removably retaining barrels and/or butt stocks of two shotguns and/or rifles and supporting the two shotguns and/or rifles horizontally one above another.

U.S. Pat. No. 6,305,534 issued to Neal, outlines a quiver having a housing and an independent rotatable carousel mounted inside the housing. The housing generally encloses the carousel and provides an opening along the length of the housing for the insertion and removal of arrows. The carousel is a rotatable device, like a rotatable magazine, which holds arrows upright. While the carousel may be free spinning, the carousel advances automatically upon the removal of each arrow from the quiver.

U.S. Pat. No. 6,308,838 issued to Endean, outlines the use of a footwear storage rack for supporting and storing footwear. The footwear storage rack includes a base, a tubular support member having a lower portion with a slot therein and having an upper portion with a retractable catch member, a footwear support member being essentially a disk and having a plurality of wedge-shaped slots extending in the circumference and the space thereabout and a handle removably attachable to the upper portion of the tubular support member for carrying and moving the footwear storage rack as desired.

U.S. Pat. No. 6,330,815 issued to Duncan, outlines the use of a mounting device for securing a firearm to a support structure such as a motor vehicle, that includes a base plate defining a generally planar mounting surface, a locking pin, a guide pin and a plurality of mounting posts extending away from the mounting surface in orthogonal relation thereto.

All of the previously described devices are useful and pertain to the safe storage of not only guns but other items as well. Some of the devices utilize technology that can be applied to the safe storage of guns. If a device could provide for a better and secure storage of a wide variety of guns with additional accessories such as scopes, than such a device could be of great value to the marketplace.

None of the above inventions and patents, taken either singly or in combination, is seen to describe the instant invention as claimed.

SUMMARY OF THE INVENTION

The invention is a revolving gun safety cabinet for holding and securing a plurality of rifles, shotguns and pistols. The revolving gun safety cabinet is made up of a multisided cabinet shell, a multisided storage compartment base used to support the multisided cabinet shell and to store gun accessories and supplies. A vertical post is set within the center of the multisided exterior cabinet shell, with a relatively large lower horizontal disk adapted to receive the butts of the rifles and shotguns held vertically upright within the revolving gun safety cabinet. There is also a relatively small upper horizontal disk adapted to receive the barrels of rifles and shotguns held vertically upright within the revolving gun safety cabinet and a locking mechanism to secure the rifles and shotguns to the vertical post.

Accordingly, it is a principal object of the invention to provide a gun cabinet that looks like a regular piece of furniture that does not draw attention to itself while situated in a room.

It is another object of the invention to provide a gun cabinet that allows the safe and proper storage of rifles and shotguns with scopes.

It is a further object of the invention to provide a gun cabinet that can safely store and secure supplemental gun materials and accessories.

Still another object of the invention is to provide a gun cabinet that can safely store pistols as well as rifles and shotguns.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
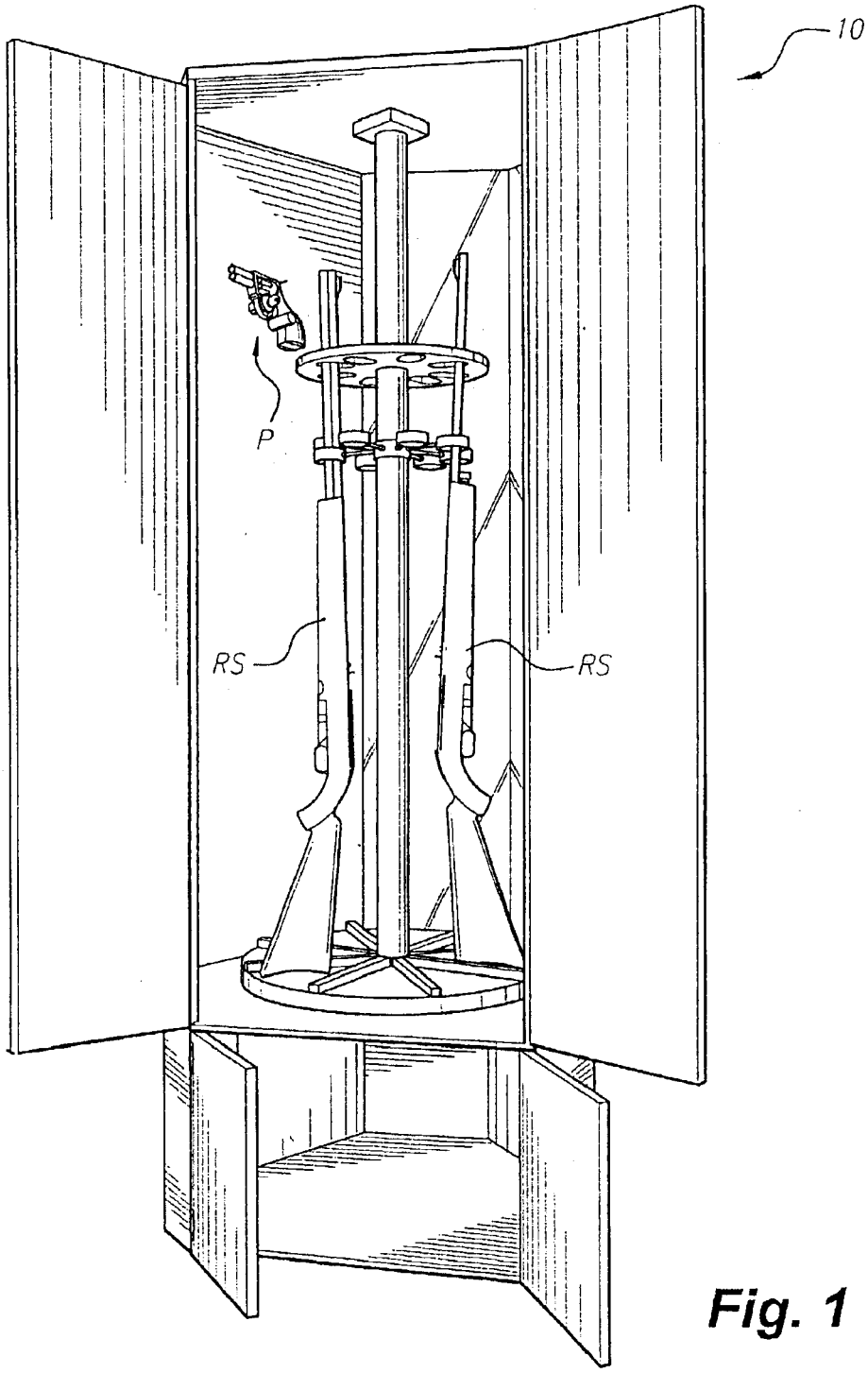
FIG. 1 is an environmental, perspective view of a revolving gun safety cabinet according to the present invention.

The present invention is a revolving gun safety cabinet 10 for holding and securing a plurality of rifles R, shotguns S and pistols P, as depicted in FIG. 1.

Figure 2:
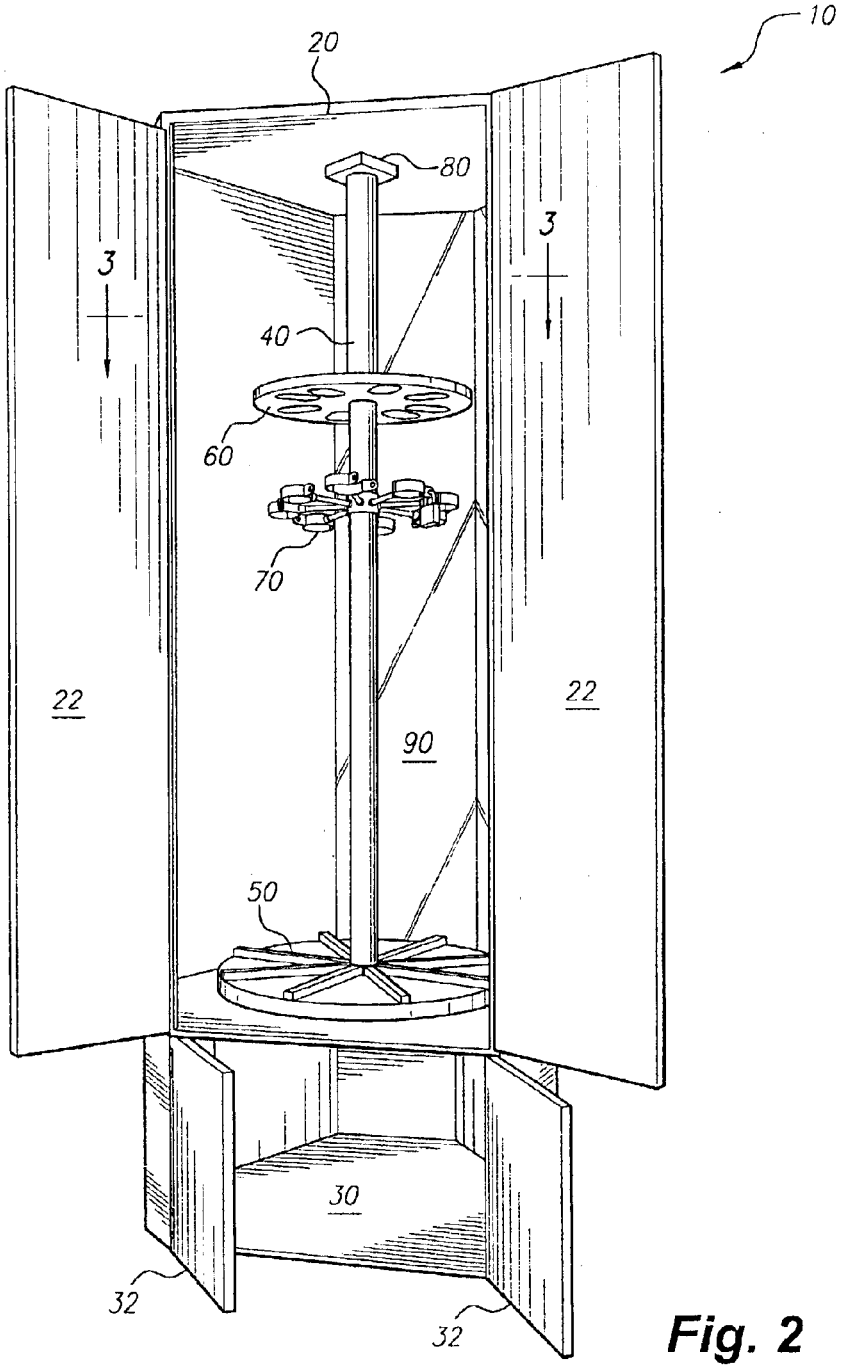
FIG. 2 is a front perspective view of a revolving gun safety cabinet.

As shown in FIG. 2, the revolving gun safety cabinet 10 comprises a multisided cabinet shell 20, a multisided storage compartment base 30 used to support the multisided cabinet shell 20 and to store gun accessories and supplies, a vertical post 40 set within the center of the multisided cabinet shell 20, a relatively large lower horizontal disk 50 having a central bore through which the vertical post 40 extends, the relatively large lower horizontal disk 50 being secured to the vertical post 40 and is rotatable therewith, adapted to receive the butts of the rifles and shotguns R&S held vertically upright within the revolving gun safety cabinet 10, a relatively small upper horizontal disk 60 having a central bore through which the vertical post 40 extends, having an inner series of holes (FIG. 3) adapted to receive the barrels of rifles and shotguns R&S held vertically upright within the revolving gun safety cabinet 10, a plurality of bolts 70 protruding from a distal location on the vertical post 40 that is between the relatively small upper horizontal disk 60 and the relatively large lower horizontal disk 50, a small square top 80 that is set at the top of the vertical post 40, with a means for locking and securing the plurality of rifles and shotguns R&S on the end of the bolts 70 and a means for locking a pistol P against an interior wall of the multisided cabinet shell 20.

Both the multisided cabinet shell 20 and the multisided base 30 have swinging doors on each side 22,32, that can also be secured with additional locks (not shown) for added security. The revolving gun safety cabinet 10 is also provided with a mirror 90 on the interior walls of the multisided cabinet shell 20. The revolving gun safety cabinet 10 can be made of wood and glass, metal and glass, or just wood or just metal. The design is an octagonal shape, which will help in the function of the revolving gun safety cabinet 10 than a more common square-shaped gun cabinet that would blend-in more with other furnishings than a more common square-shaped gun cabinet. The octagonal revolving gun safety cabinet's 10 appearance will also draw attention away from itself as opposed to a square-shaped gun cabinet.

Figure 3:
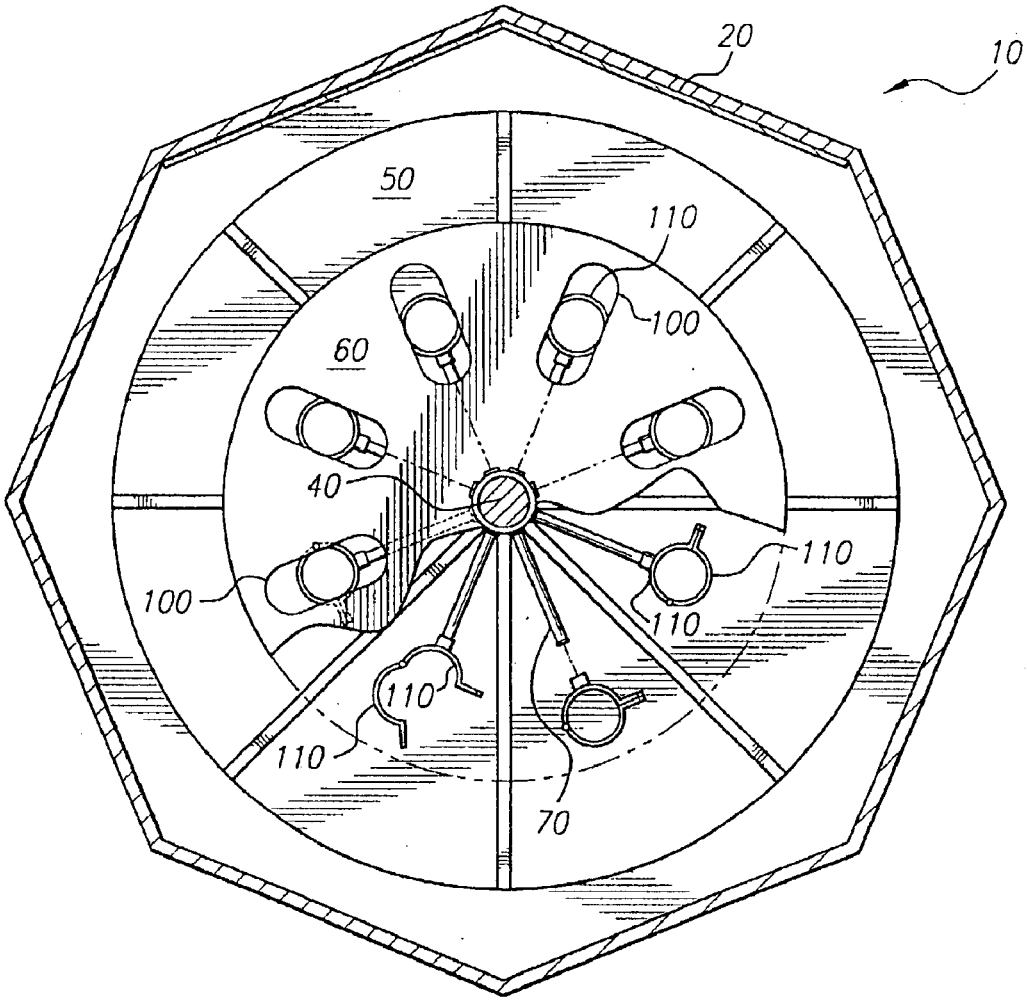
FIG. 3 is a cross-sectional perspective view of a revolving gun safety cabinet along line 3—3 on FIG. 2.

The revolving gun safety cabinet 10 is designed to lock rifles R, shotguns S and pistols P in place so they cannot be removed without a key to unlock each one. The revolving gun safety cabinet 10 holds 8 rifles and shotguns R&S and can accommodate any number of pistols P depending on the number of pistol holders on the interior walls of the multisided cabinet shell 20 (one pistol holder can secure one pistol). As shown in FIG. 3, the rifles and shotguns R&S sit on ⅛th sections of the relatively large lower horizontal disk 50 with barrels sticking upwards towards the means for locking and securing the plurality of rifles and shotguns R&S on the distal end of the bolts 70 and the relatively small upper horizontal disk 60. Unfortunately, on most gun cases, rifles and shotguns R&S with scopes don't fit correctly and can cause damage to the rifles and shotguns R&S. Because of its octagonal shape, there is enough room to accommodate attached scopes without the scopes hitting the interior walls of the revolving gun safety cabinet 10. With the revolving gun safety cabinet 10, rifles and shotguns R&S with scopes are supported and are safe from falling over. Also a user does not have to remove 2 or 3 rifles and shotguns R&S to get to the back of the revolving gun safety cabinet 10. To get any rifle or shotgun R or S, a user can just revolve the relatively large lower horizontal disk 50 around and select and unlock the rifle or shotgun R or S desired.

As is also shown in FIG. 3, there are a plurality of holes 100 to accommodate each shotgun barrel or rifle barrel that can be stored on the relatively large lower horizontal disk 50. A small square top 80 is also provided on the top of the vertical post 40. The small square top 80 does not receive or accommodate any part of any rifles or shotguns R or S stored in the revolving gun safety cabinet 10 and is set on top of the vertical post 40 and revolves with the vertical post 40.

Figure 4:
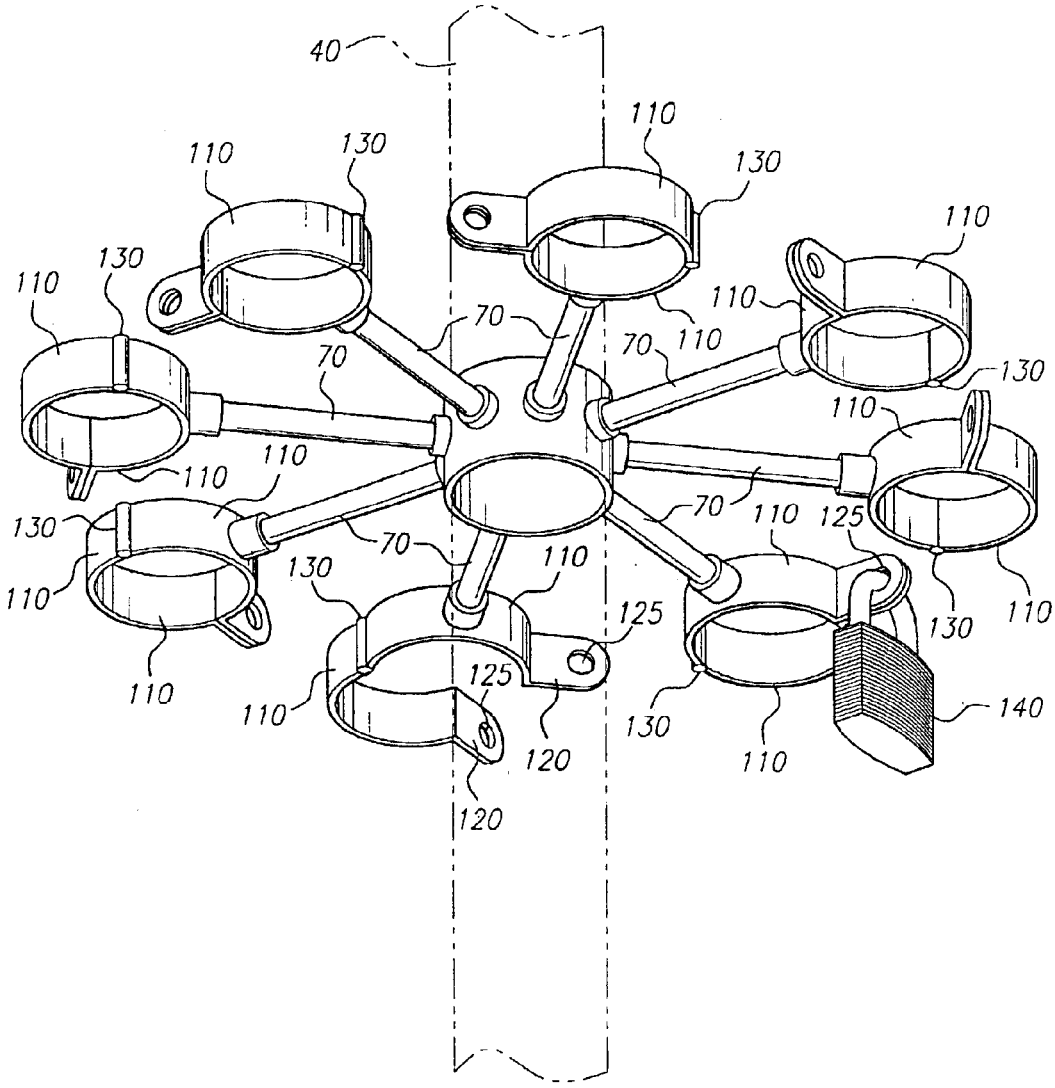
FIG. 4 is an isolated perspective view of a safety lock for shotguns and rifles.

FIG. 4 depicts the means for locking and securing the plurality of rifles and shotguns R&S, which is a hinged pair of semi-circular aperture encasings 110 that enclose around each rifle and shotgun barrel and are locked together with a padlock and key 140. A pair of semi-circular aperture encasings 110 are provided on the distal end of each bolt 70 that extends from the vertical post 40. Each pair of semi-circular aperture encasings 110 are held together by a hinge 130 that can separate or bring each encasing together. Each semi-circular aperture encasing 110 has a single tab 120 that also has a single aperture 125. When each semi-circular encasing 110 is brought together, each single tab 120 and single aperture 125 are designed to accommodate a padlock and key 140, thereby securing any gun barrel that may be encased within the semi-circular aperture encasings 110.

Figure 5:
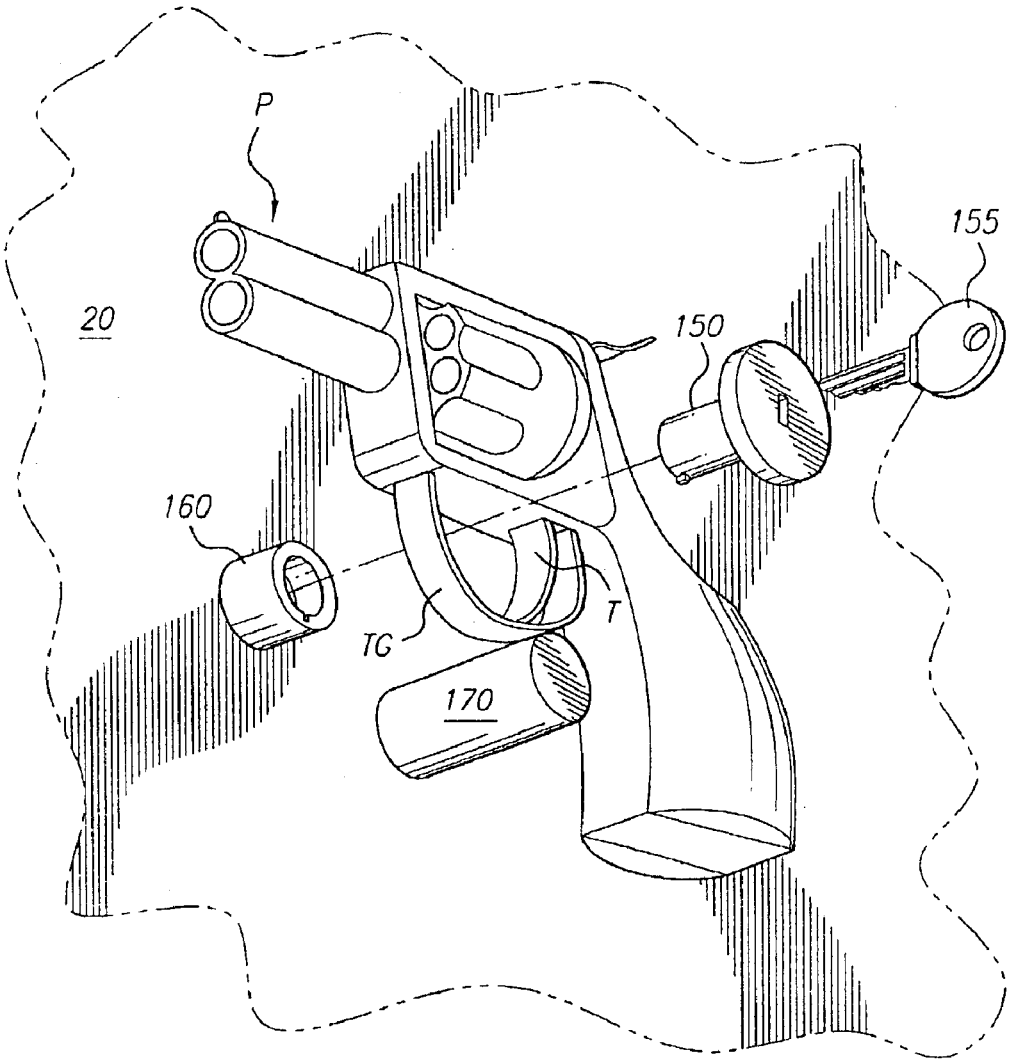
FIG. 5 is an isolated perspective view of a safety lock for pistols.

As shown in FIG. 5, the revolving gun safety cabinet 10 also has a means for locking a pistol P against an interior wall of the multisided cabinet shell 20, which is the male portion of a trigger lock 150 that is inserted through the area between the trigger T and trigger guard TG of the pistol P and is inserted into the female portion of the trigger lock 160 that is mounted on the interior wall of the multisided cabinet shell 20. A key 155 can be inserted in the male portion of a trigger lock 150 to lock and unlock the trigger lock mechanism. A stationary protruding peg 170 is mounted on the interior wall of the multisided cabinet shell 20 directly underneath the trigger guard TG. The stationary protruding peg 170 helps hold the pistol P on the interior wall of the multisided cabinet shell 20 and complements the trigger lock mechanism.

Use of the revolving gun safety cabinet 10 is uncomplicated. A user can store up to 8 rifles and shotguns R&S with or without scopes and can lock each rifle and shotgun R&S individually with an exterior lock 140. As noted earlier, the number of pistols P stored and secured in the revolving gun safety cabinet 10 is simply equal to the number of trigger locks provided on the interior wall of the multisided cabinet shell 20. The revolving gun safety cabinet 10 can be made of wood and glass or metal and glass, as well as wood only or metal only, and can be secured with additional exterior locks (not shown) for the multisided cabinet shell 20 and multisided base 30. The vertical post 40 can be made of wood or fiberglass and the relatively large lower horizontal disk 50 and relatively small upper horizontal disk 60 can be rotated manually to gain access to any rifle or shotgun R or S.

It is to be understood that the present invention is not limited to the sole embodiment described above, but encompasses any and all embodiments within the scope of the following claims.

We claim:

1. A safety cabinet for holding and securing a plurality of firearms, comprising:

a multisided cabinet shell, having a plurality of walls;

said walls defining an interior surface and an exterior surface;

a multisided storage compartment base supporting said multisided cabinet shell;

whereby said compartment base stores firearm accessories and supplies;

a vertical post rotatably disposed in the center of the multisided cabinet shell;

a lower horizontal disk having a central bore through which the vertical post extends, the lower horizontal disk being secured to the vertical post and rotatable therewith;

whereby said lower horizontal disk is designed and configured to receive the butt ends of a plurality of rifles and shotguns, so as to support the plurality of rifles and shotguns vertically;

a upper horizontal disk having a central bore through which the vertical post extends, the upper disk defining a plurality of holes;

whereby said plurality of holes receive the barrel ends of the plurality of rifles and shotguns, so as to retain the plurality of rifles and shotguns upright on the lower horizontal disk;

a plurality of bolts extending from the vertical post at a location between the upper horizontal disk and the lower horizontal disk;

each one of the plurality of bolts having a distal end;

a ring for locking and securing the plurality of rifles and shotguns disposed on the distal end of each one of the plurality of bolts;

the ring including a hinged pair of semi-circular portions;

a padlock;

wherein each ring encloses one of the plurality of rifles and shotguns about a barrel portion, and are locked together with the padlock; and means for locking at least one pistol against an interior wall of the multisided cabinet shell.

2. The revolving gun safety cabinet according to claim 1, wherein said means for locking at least one pistol against an interior wall of the multisided cabinet shell includes a trigger lock having a male portion and a female portion, and a support peg; one portion of the trigger lock and the support peg are mounted on the interior wall.

3. The revolving gun safety cabinet according to claim 1, wherein the multisided cabinet shell is octagonal.

4. The revolving gun safety cabinet according to claim 1, further comprising a full-length mirror on at least one interior wall of the multisided cabinet shell.

5. The revolving gun safety cabinet according to claim 1, wherein the revolving gun safety cabinet is made of wood.

6. The revolving gun safety cabinet according to claim 1, wherein the revolving gun safety cabinet is made of metal.

7. The revolving gun safety cabinet according to claim 1, wherein the revolving gun safety cabinet is made of wood and glass.

8. The revolving gun safety cabinet according to claim 1, wherein the revolving gun safety cabinet is made of metal and glass.

9. A safety cabinet for holding and securing a plurality of firearms, comprising:

a multisided cabinet shell, having a plurality of walls;

said walls defining an interior surface and an exterior surface;

a multisided storage compartment base supporting said multisided cabinet shell;

whereby said compartment base stores firearm accessories and supplies;

a vertical post rotatably disposed in the center of the multisided cabinet shell;

a lower horizontal disk having a central bore through which the vertical post extends, the lower horizontal disk being secured to the vertical post and rotatable therewith;

whereby said lower horizontal disk is designed and configured to receive the butt ends of a plurality of rifles and shotguns, so as to support the plurality of rifles and shotguns vertically;

a upper horizontal disk having a central bore through which the vertical post extends, the upper disk defining a plurality of holes;

whereby said plurality of holes receive the barrel ends of the plurality of rifles and shotguns, so as to retain a plurality of firearms upright on the lower horizontal disk;

a plurality of bolts protruding from the vertical post at a location between the upper horizontal disk and the lower horizontal disk, each bolt having a distal end;

and means for locking and securing the plurality of firearms on the distal end of each bolt; and means for locking at least one pistol against the interior of at least one wall;

wherein said means for locking at least one pistol against the interior of at least one wall includes trigger lock having a male portion and a female portion, and a support peg;

whereby one portion of the trigger lock and the support peg are mounted on the interior of the at least one wall.

10. The revolving gun safety cabinet according to claim 9, wherein said means for locking and securing the plurality of firearms is a ring for enclosing a barrel of each firearm and a padlock.

11. The revolving gun safety cabinet according to claim 9, wherein the multisided cabinet shell is octagonal.

12. The revolving gun safety cabinet according to claim 9, further comprising a full-length mirror on at least one interior wall of the multisided cabinet shell.

13. The revolving gun safety cabinet according to claim 9, wherein the revolving gun safety cabinet is made of wood.

14. The revolving gun safety cabinet according to claim 9, wherein the revolving gun safety cabinet is made of metal.

15. The revolving gun safety cabinet according to claim 9, wherein the revolving gun safety cabinet is made of wood and glass.

16. The revolving gun safety cabinet according to claim 9, wherein the revolving gun safety cabinet is made of metal and glass.

* * * * *